United States Patent [19]

Trottet

[11] 4,422,632

[45] Dec. 27, 1983

[54] TILTABLE TENNIS COURT

[76] Inventor: Pierre Trottet, Le Coulet 1165, Allamand, Switzerland

[21] Appl. No.: 382,240

[22] Filed: May 26, 1982

[30] Foreign Application Priority Data

Jun. 4, 1981 [CH] Switzerland ..... 3668/81

[51] Int. Cl.[3] ..... A63J 3/00

[52] U.S. Cl. ..... 272/3; 273/29 R; 52/64

[58] Field of Search ..... 273/29, 3 R, 3 A, 3 B, 273/4 R, 4 C; 52/64

[56] References Cited

U.S. PATENT DOCUMENTS

| | | | |
|---|---|---|---|
| 747,726 | 12/1903 | Karhan | 272/3 |
| 3,745,729 | 7/1973 | Vaughn et al. | 273/29 R |
| 3,935,687 | 2/1976 | Vaughn et al. | 273/29 R |
| 3,980,304 | 9/1976 | O'Neill et al. | 273/29 R |
| 4,006,565 | 2/1977 | Thompson | 273/29 R |
| 4,045,022 | 8/1977 | Grant et al. | 273/29 R |
| 4,078,795 | 3/1978 | Porter | 273/29 R |
| 4,198,042 | 4/1980 | Olson | 273/29 R |

*Primary Examiner*—Richard C. Pinkham
*Assistant Examiner*—T. Brown
*Attorney, Agent, or Firm*—Emory L. Groff, Jr.

[57] ABSTRACT

A panel (1) is mounted on a frame (2) which in turn is mounted on a pivot (3) disposed parallel to the longitudinal axis of the panel (1). Jacks (4) connected to the frame permit tilting the panel (1) which constitutes the tennis court. In this inclined position of the panel (1), rainwater will not accumulate on the court and the court can be reused as soon as the rain ceases to fall.

3 Claims, 4 Drawing Figures

TILTABLE TENNIS COURT

This invention relates to a tennis court.

Tennis courts are normally constructed on the ground in a perfectly horizontal plane. Generally, the playing surface of a tennis court is formed of macadam, clay, a bed of concrete or other rigid or semi-rigid material.

The tennis court according to my invention is conceived in such a manner so as to be movable and permit inclination thereof with reference to a horizontal plane.

The invention is characterized in that it comprises a panel mounted on a pivot which is oriented along the longitudinal axis of the panel.

The attached drawing shows schematically and by way of example a preferred form of execution of a tennis court according to my invention wherein.

Figure 1:
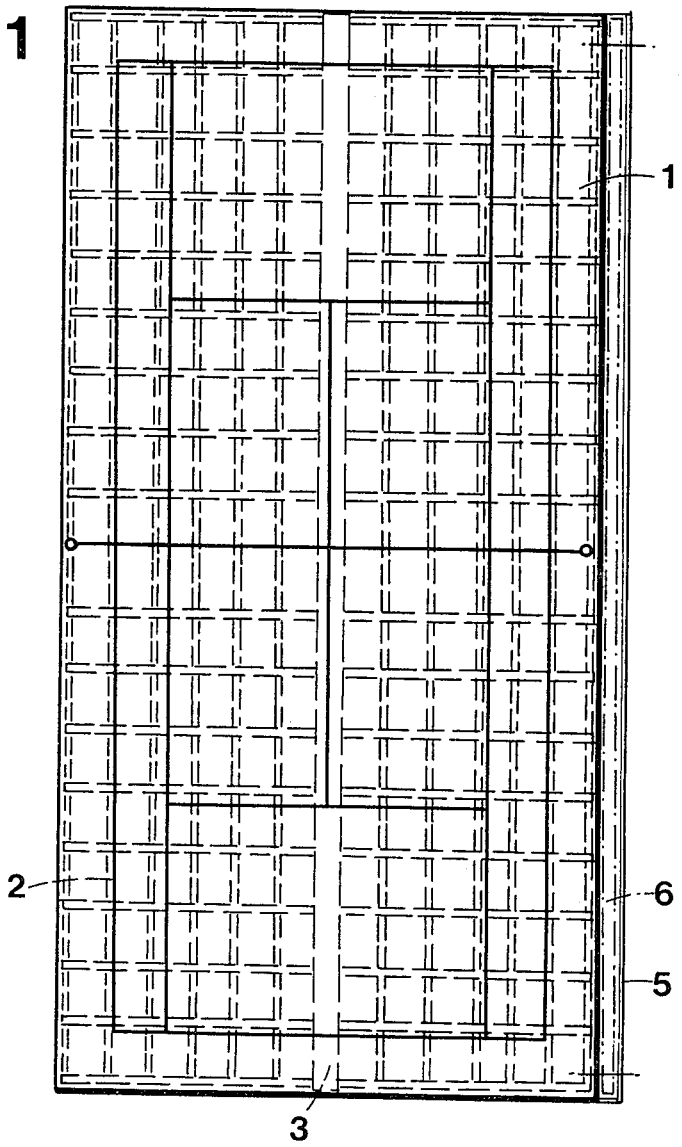
FIG. 1 is a top plan view.
Figure 2:
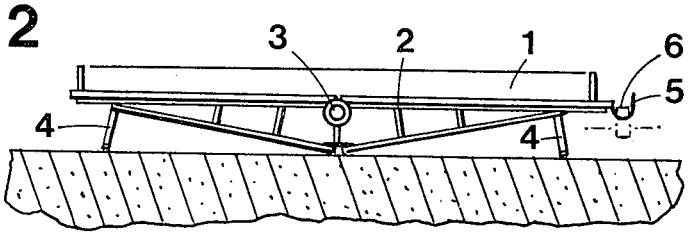
FIG. 2 is an end view of a first position of the tennis court.
Figure 3:
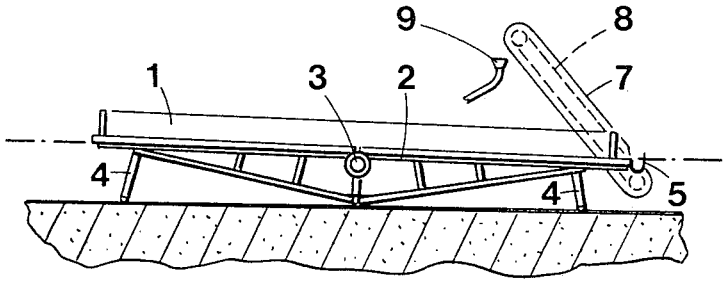
FIG. 3 is an end view of a second position of the tennis court.
Figure 4:
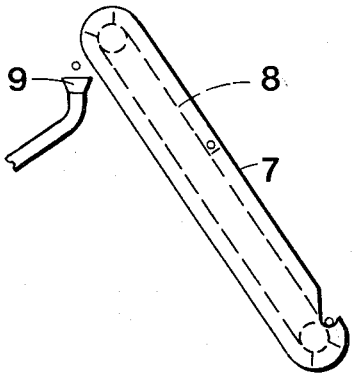
FIG. 4 shows an accessory intended to feed an apparatus for returning the tennis balls to the player.

The tennis court shown in the drawing comprises a panel 1 of compressed wood or other compressed material, such as a product sold under the trademark ETERNIT, disposed on a metal frame 2 mounted on a pivot 3 oriented along the longitudinal axis of the panel 1. Jacks 4 are disposed adjacent the longitudinal edges of the frame 2 thus permitting inclined lateral adjustment of the panel 1 which is provided along one of its longitudinal edges with a gutter 5. A slight lateral inclination of the panel 1, such as shown in FIG. 3, permits run-off of rainwater into the gutter 5. Thus, any accumulation of water on the panel 1 in case of rain can be avoided and deterioration of the surface of the panel 1 which could result is also avoided. Furthermore, it is possible to use the court very shortly after the rain has stopped falling.

By equipping the gutter 5 with a conveyor belt 6 driven by an electric motor, it is possible in the slightly inclined position of the panel 1, to collect in the gutter 5 tennis balls which are out of play and direct them towards one end of the panel. Located at one end of the gutter 5 is a ball collector 7 which also includes a conveyor belt 8 driven by an electric motor. This arrangement conveys the balls upwardly to a point where they fall into the receptacle 9 of a ball return or throwback device (not shown) which allows a player to practice on the court by himself.

It is, of course, possible to collect the balls directed to the one end of the gutter 5 by the conveyor belt 6 into a groove provided in a portion of a blower mechanism which propels the balls toward the ball return device by the force of the air generated by said blower.

In a case where the panel is made of the product sold under the trademark ETERNIT, or other similar material, which has a tendency to expand under the effect of heat, it is preferable to dispose side by side on the metal frame 2 a plurality of separate panel elements and maintain them in contact with one another by means of reslient members such as compression springs located between the edges of the metal frame 2 and the panel elements adjacent said edges. Also, a vibrator facilitating the bringing together of the separate elements is mounted beneath the frame 2.

Among other advantages provided by the tennis court described above is the possibility of moving it, without any deterioration thereof to another location when desired.

I claim:

1. A tennis court characterized in that it comprises a panel and a pivot on which said panel is mounted, said pivot oriented along the longitudinal axis of said panel, a frame supporting said panel and engaging said pivot, and jacks at opposite sides of said frame to adjust the lateral inclination of the panel- has been inserted.

2. A tennis court according to claim 1 including, a gutter along one of the longitudinal edges of said panel and a motor driven conveyor belt in said gutter.

3. A tennis court according to claim 2 including, a second conveyor belt driven by a motor disposed in an enclosure at the discharge end of the first conveyor belt, said second conveyor belt receiving balls carried by the first conveyor belt transferring them into a ball return apparatus.

* * * * *